US009538623B2

(12) United States Patent
Lee et al.

(10) Patent No.: US 9,538,623 B2
(45) Date of Patent: Jan. 3, 2017

(54) LIGHTING DEVICE

(71) Applicant: LG ELECTRONICS INC., Seoul (KR)

(72) Inventors: Jaemyoung Lee, Seoul (KR); Heegu Park, Seoul (KR); Inhwan Ra, Seoul (KR); Sunghoon Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/701,601

(22) Filed: May 1, 2015

(65) Prior Publication Data

US 2015/0327349 A1 Nov. 12, 2015

(30) Foreign Application Priority Data

May 12, 2014 (KR) ..... 10-2014-0056290
Aug. 11, 2014 (KR) ..... 10-2014-0103942

(51) Int. Cl.
*H05B 37/02* (2006.01)
*F21V 23/00* (2015.01)
(Continued)

(52) U.S. Cl.
CPC ..... *H05B 37/0272* (2013.01); *F21K 9/232* (2016.08); *F21V 7/22* (2013.01); *F21V 23/005* (2013.01);
(Continued)

(58) Field of Classification Search
CPC . H05B 37/0272; H05B 33/0809; F21V 29/70; F21V 7/22; F21V 23/005; F21V 23/006; F21V 23/02; F21V 23/0435; F21V 23/045; F21K 9/135; F21Y 2101/02; F21Y 2105/045
(Continued)

(56) References Cited

U.S. PATENT DOCUMENTS

2013/0136454 A1 5/2013 Yu
2014/0021862 A1 1/2014 Chung
(Continued)

FOREIGN PATENT DOCUMENTS

CN 201661913 U 12/2010
EP 2 690 359 A1 1/2014
(Continued)

OTHER PUBLICATIONS

European Search Report issued in Application No. 15167109.6 dated Jul. 21, 2015.
(Continued)

*Primary Examiner* — Laura Tso
(74) *Attorney, Agent, or Firm* — KED & Associates, LLP

(57) ABSTRACT

Provided is a lighting device. The lighting device includes a light emitting diode (LED) printed circuit board (PCB) on which LED devices for emitting light are disposed, the LED PCB controlling an operation of each of the LED devices, a converter PCB for supplying power into the LED PCB, a housing having a space in which the LED PCB is accommodated, the housing having a heat dissipation structure, a communication module disposed under the LED PCB, the communication module allowing the lighting device to communicate with an external device, and a signal receiving unit connected to the communication module, the signal receiving unit being disposed on the LED PCB. The LED PCB may have a through hole through which an upper end of the communication module passes, and the signal receiving unit is coupled to the upper end of the communication module passing through the through hole.

17 Claims, 20 Drawing Sheets

(51) Int. Cl.

| | |
|---|---|
| ***F21V 29/70*** | (2015.01) |
| ***F21V 7/22*** | (2006.01) |
| ***F21V 23/02*** | (2006.01) |
| ***H05B 33/08*** | (2006.01) |
| ***F21V 23/04*** | (2006.01) |
| *F21Y 101/00* | (2016.01) |

(52) U.S. Cl.
CPC ..... *F21V 23/006* (2013.01); *F21V 23/02* (2013.01); *F21V 23/045* (2013.01); *F21V 23/0435* (2013.01); *F21V 29/70* (2015.01); *H05B 33/0809* (2013.01); *F21Y 2101/00* (2013.01); *F21Y 2105/10* (2016.08); *F21Y 2105/12* (2016.08)

(58) Field of Classification Search
USPC ..... 362/294, 650
See application file for complete search history.

(56) References Cited

U.S. PATENT DOCUMENTS

2014/0168020 A1* 6/2014 Stoytchev ..... H05B 33/0803 343/721
2015/0070895 A1* 3/2015 Yotsumoto ..... F21K 9/1355 362/253
2015/0117037 A1* 4/2015 Fan ..... F21V 23/005 362/375
2015/0345764 A1* 12/2015 Hussey ..... F21V 23/006 362/235

FOREIGN PATENT DOCUMENTS

| | | | |
|---|---|---|---|
| JP | 2012-227021 | A | 11/2012 |
| KR | 10-2014-0013280 | A | 2/2014 |
| KR | 10-2014-0023483 | | 2/2014 |
| WO | WO 2012/150589 | A1 | 11/2012 |
| WO | WO 2013/031043 | A1 | 3/2013 |

OTHER PUBLICATIONS

Korean Office Action dated Oct. 30, 2015 issued in Application No. 10-2014-0056290.
Korean Office Action dated Jan. 30, 2016 issued in Application No. 10-2014-0103942.

* cited by examiner

LIGHTING DEVICE

CROSS-REFERENCE TO RELATED APPLICATION(S)

This application claims priority under 35 U.S.C. §119 to Korean Application No. 10-2014-0056290 filed on May 12, 2014 and No. 10-2014-0103942 filed on Aug. 11, 2014, whose entire disclosure is hereby incorporated by reference.

BACKGROUND

1. Field

This relates to a lighting device, and more particularly, to a lighting device having a wireless antenna.

2. Background

Intelligent lighting systems may employ radio frequency (RF) communication to remotely manage lamps in, for example, home and office environments. When employing RF communication in this manner, RF control signals may be transmitted to various lighting devices. However, power supplied to the lighting devices, for example, a voltage applied to the lamps, is not typically controlled in this manner to control light sources or lighting devices of these types of lamps.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings.

ZigBee communication may be suitable for applications having relatively low data rates such as the remote management of a lamp or lighting system. In ZigBee communication, a transmitted control signal may be used to remotely turn a lamp on or off, and/or adjust a brightness level, a beam width, and/or a light emission direction of the lamp. To be controlled in this manner, the lamp may employ an antenna so as to effectively transmit and/or receive such remote management control signals.

An antenna provided in a lamp may shield an RF signal in a certain direction or may change a resonance frequency of the antenna. Such an antenna would be mounted on the lamp to prevent the lamp from interfering with other lamps formed of an electrically conductive material for RF communication. Therefore, the antenna may provide a directional gain and may radiate a signal in a large solid angle, and may be installed so as to secure a sufficient gain and reliably communicate with other lamps and remote control devices.

When such a lamp includes a light emitting diode (LED) as a light source, a structure for dissipating high temperature heat generated by the LED may be necessary to ensure integrity of the lamp. The heat dissipation structure or a housing or socket of the lamp may be designed to prevent the antenna provided in the lamp from interfering when the antenna transmits/receives signals.

Figure 1:
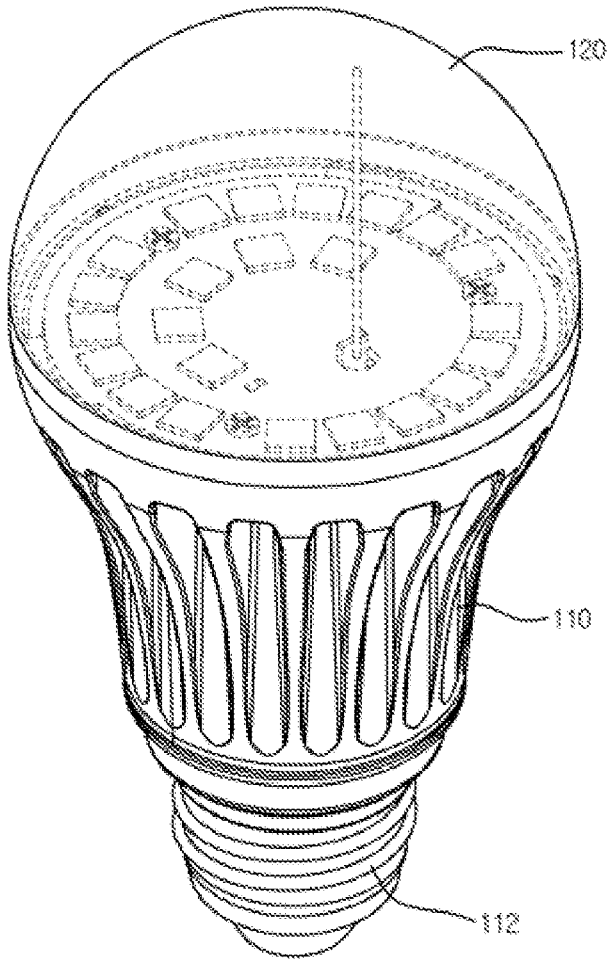
FIG. 1 is a view of an exterior of a lighting device according to an embodiment.
Figure 2:
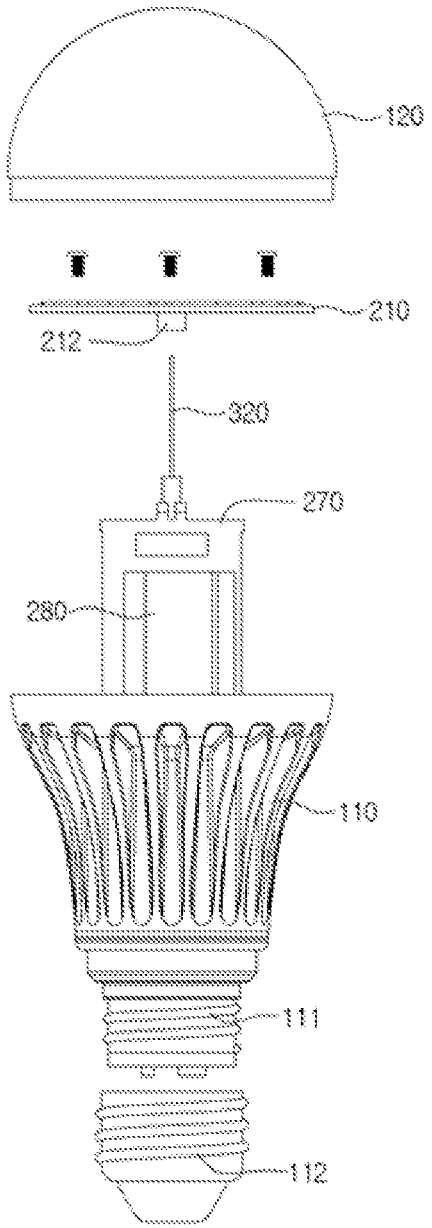
FIGS. 2 and 3 are views of a light emitting diode (LED) device disposed in the lighting device and a circuit configuration for driving the LED device according to an embodiment.
Figure 3:
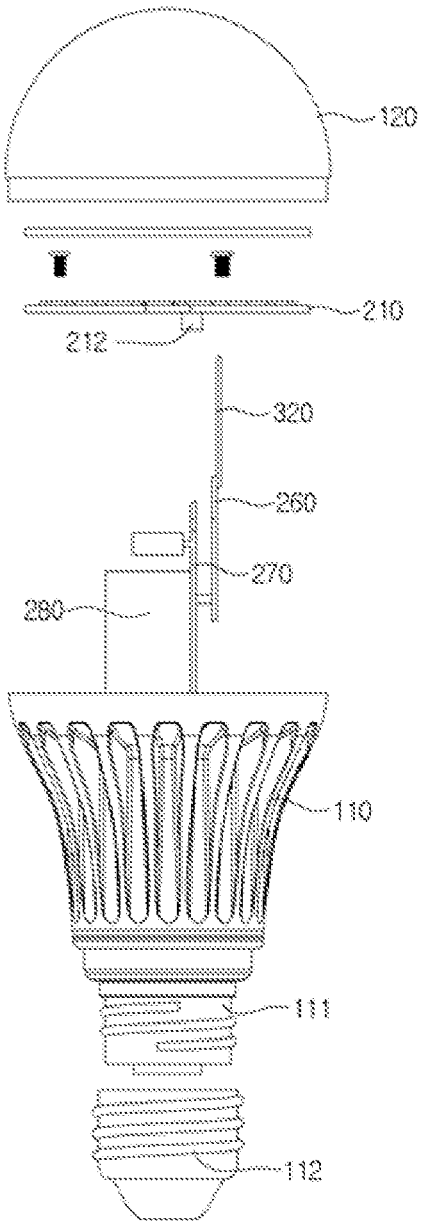

FIG. 1 is a view of an exterior of a lighting device according to an embodiment. FIGS. 2 and 3 are views of a light emitting diode (LED) device disposed in the lighting device and a circuit configuration for driving the LED device according to an embodiment.

A lighting device according to an embodiment includes a housing 110 defining a lower portion thereof and a cover 120 coupled to an upper portion of the housing 110 to transmit light generated from a light emitting diode (LED). Also, a socket 112 connected to an external device supplying a power is disposed below the housing 110.

The housing 110 may include a plurality of ribs each formed of a material having high heat conductivity so as to dissipate heat generated by an operation of the LED device or heat generated by an operation of a converter to the outside.

Referring to FIGS. 2 and 3, the lighting device according to an embodiment includes a converter printed circuit board (PCB) 270 accommodated in the housing 110, a communication module 260 spaced a predetermined distance from the converter PCB 270, and a signal receiving unit 320 connected to one end of the communication module 260.

Also, the lighting device according to an embodiment may further include a power connector 111 for allowing the lighting device to be electrically connected to the external device supplying a power and the socket 112 coupled to an outer surface of the power connector 111, which are disposed below the housing 110.

The converter PCB 270 converts a commercial alternating current (AC) power into a direct current (DC) power to apply the converted power into the LED device. A conversion unit 280 for converting intensity of the power may be further disposed in the converter PCB 270. The converter PCB 270 may have a shape extending in a longitudinal direction of the housing 110. The converter PCB 270 may be accommodated in the housing 110.

A converter connection unit 212 connected to the converter PCB 270 is disposed on the LED PCB 210 so that the power converted by the converter PCB 270 is transmitted into the LED PCB 210.

The converter PCB 270 may be electrically connected to the LED PCB 210 via the converter connection unit 212. The LED PCB 210 may control an operation of each of the LED devices by using the transmitted DC power. Although the LED devices operate using the DC power in the current embodiment, the present disclosure is not limited thereto. For example, it may be considered that the LED devices operate using the AC power.

The communication module 260 may be spaced a predetermined distance from one surface of the converter PCB 270. The communication module 260 may also have a shape vertically extending in the same direction as that of the converter PCB 270. That is, each of the communication module 260 and the converter PCB 270 may have a shape extending in a direction parallel to that in which the light generated from the LED device travels.

The communication module 260 has a shape in which a portion of the communication module 260 is accommodated in the housing 110. The signal receiving unit 320 for receiving a wireless signal from the outside is coupled to one surface of the communication module 260.

The wireless signal received by the signal receiving unit 320 is transmitted to the communication module 260. The communication module 260 may check a command included in the wireless signal. Then, resultant control data may be transmitted into the converter PCB 270 and the LED PCB 210 to control an on/off operation and brightness of the LED device.

The signal receiving unit 320 needs to be mounted spaced a predetermined distance from the converter PCB 270 or the housing 110. This is done for reducing signal interference due to noises generated when the power is converted between the AC and the DC or signal interference generated when the heat is dissipated through the housing.

In the current embodiment, the signal receiving unit 320 may be mounted so that an end of the signal receiving unit 320 is spaced a predetermined distance from a top surface of the LED PCB 210. That is, a portion of the communication module 260, in which the signal receiving unit 320 is coupled to the one surface of the communication module 260 may be disposed higher than the top surface of the LED PCB 210.

An end of the signal receiving unit 320 may be disposed higher than an upper end of the housing 110. A lower end of the signal receiving unit 320 may be disposed higher than a top surface of the housing 110 so as to minimize the signal interference due to the housing 110 and to maintain a distance between components accommodated in the housing 110. The relative position of the signal receiving unit 320 will be described in more detail with reference to the accompanying drawings.

Figure 4:
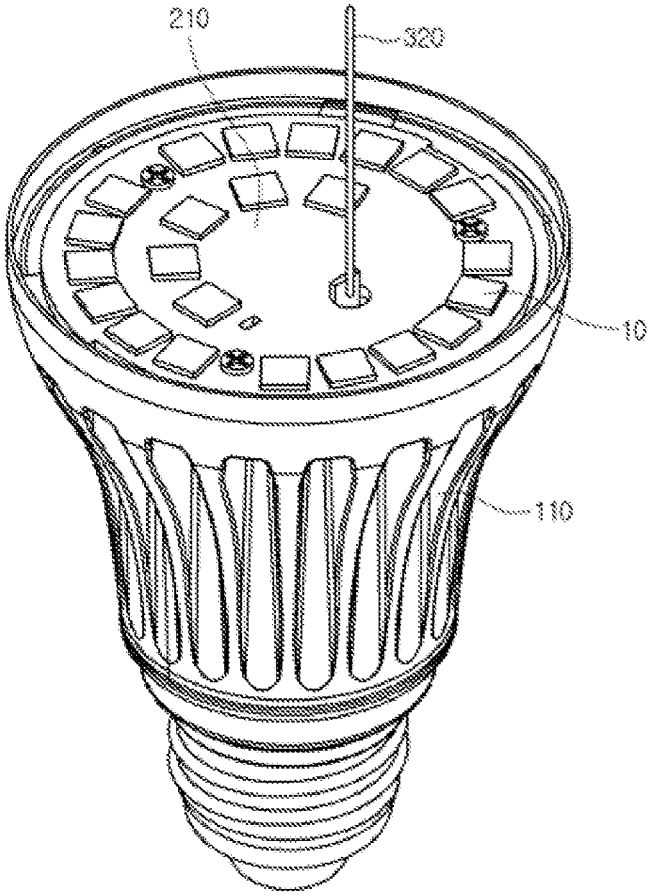
FIG. 4 is a view of a state where a cover is removed from the lighting device according to an embodiment.
Figure 5:
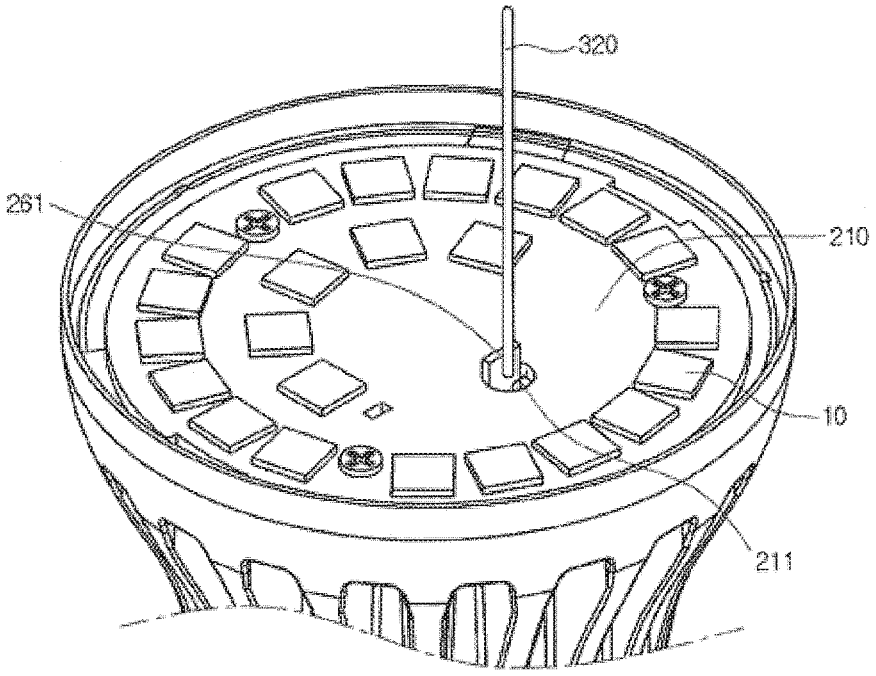
FIG. 5 is an enlarged view illustrating a portion of a top surface of an LED printed circuit board (PCB)
Figure 6:
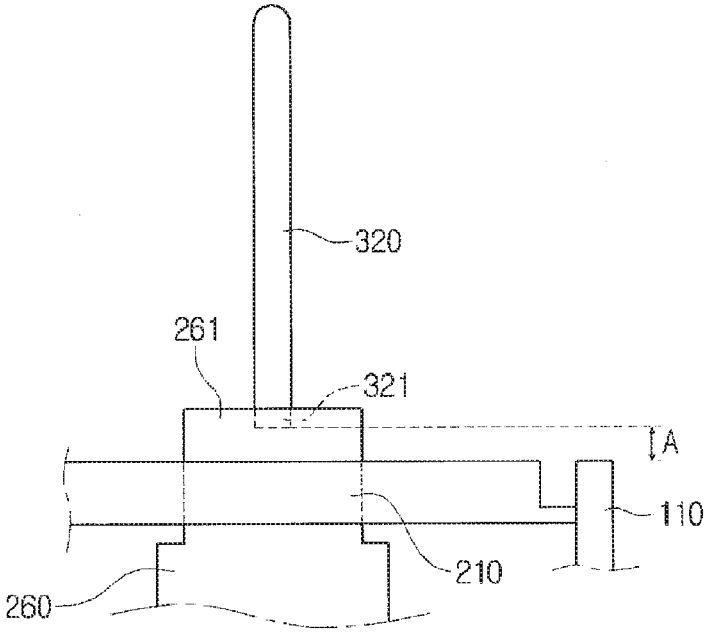
FIG. 6 is a cross-sectional view for illustrating a connection position of a signal receiving unit.

FIG. 4 is a view of a state where the cover is removed from the lighting device according to an embodiment, FIG. 5 is an enlarged view illustrating a portion of a top surface of the LED PCB, and FIG. 6 is a cross-sectional view for illustrating a connection position of the signal receiving unit.

Referring to FIGS. 4 to 6, a plurality of LED devices 10 are disposed on the LED PCB 210 according to an embodiment. The LED PCB 210 may control an operation of each of the LED devices 10. Also, a through hole 211 having a size to allow the signal receiving unit 320 to pass may be defined in the LED PCB 210.

A portion of an upper end 261 of the communication module 260 may pass through the through hole 211 so that the lower end of the signal receiving unit 320 is disposed higher than the top surface of the housing 110.

That is, as illustrated in FIG. 5, the upper end 261 of the communication module 260 may pass through the through hole 211 to protrude by a predetermined height. The signal receiving unit 320 may be coupled to the upper end 261 of the communication module 260 through a connection method such as soldering.

In this case, it is unnecessary that the signal receiving unit 320 is inserted upward from a lower portion of the through hole 211 after the signal receiving unit 320 is coupled to the communication module 260. A worker may couple the upper end 261 of the communication module 260 to the through hole 211 to pass through the through hole 211 and then couple the signal receiving unit 320 to the protruding upper end 261 of the communication module 260.

As described above, since the upper end 261 of the communication module 260 protrudes from a through hole 211 by a predetermined height, the signal receiving unit 320 may be easily coupled to the communication module 260, and also the lower end of the signal receiving unit 320 may be disposed higher than the housing 110.

According to modification of the embodiment, the lower end of the signal receiving unit 320 may be disposed on a bottom surface of the LED PCB 210 or under the LED PCB 210.

An example of a coupling position of the signal receiving unit 320 is described with reference to FIG. 6. A portion of the upper end 261 of the communication module 260 passes through the through hole 211 and is disposed at a predetermined height from a top surface of the LED PCB 210.

Also, the lower end 321 of the signal receiving unit 320 is electrically coupled to the protruding upper end 261 of the communication module 260. Here, the signal receiving unit 320 may be coupled to the upper end 261 of the communication module 260 so that a height difference A is generated between the lower end 321 of the signal receiving unit 320 and upper ends of left and right sides of the housing 110, or so that the lower end 321 of the signal receiving unit 320 is disposed at the same height as that of at least an upper end of the housing 110.

In another embodiment, the upper end 261 of the communication module 260 may be fixed by passing through the through hole 211 so that the upper end 261 of the communication module 260 is disposed higher than the top surface of the housing 110. Here, the lower end 321 of the signal receiving unit 320 and the upper end 261 of the communication module 260 may be disposed higher than the top surface of the housing 110.

A position where the through hole 211 is defined will be described with reference to FIGS. 7 to 9.

Figure 7:
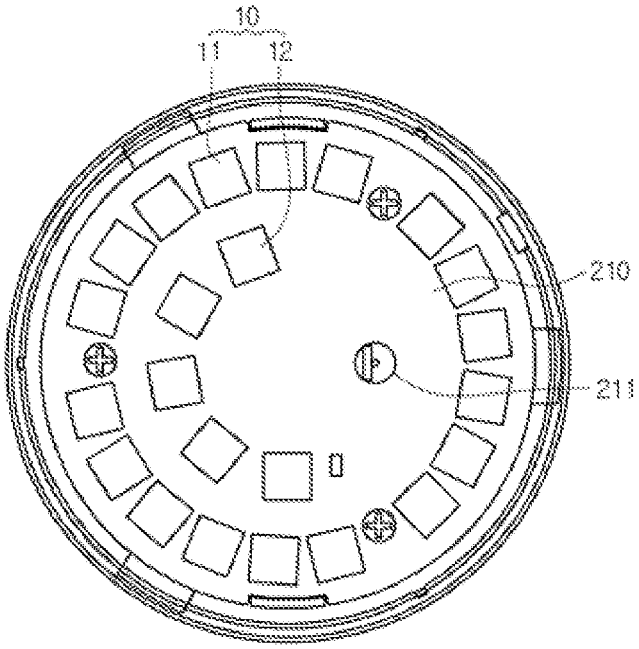
FIG. 7 is a view of a through hole of the lighting device according to an embodiment.
Figure 8:
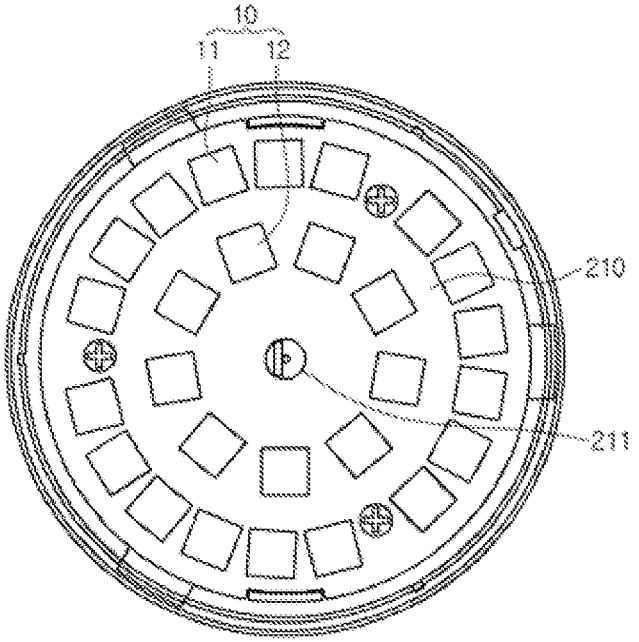
FIG. 8 is a view of a through hole of a lighting device according to another embodiment.
Figure 9:
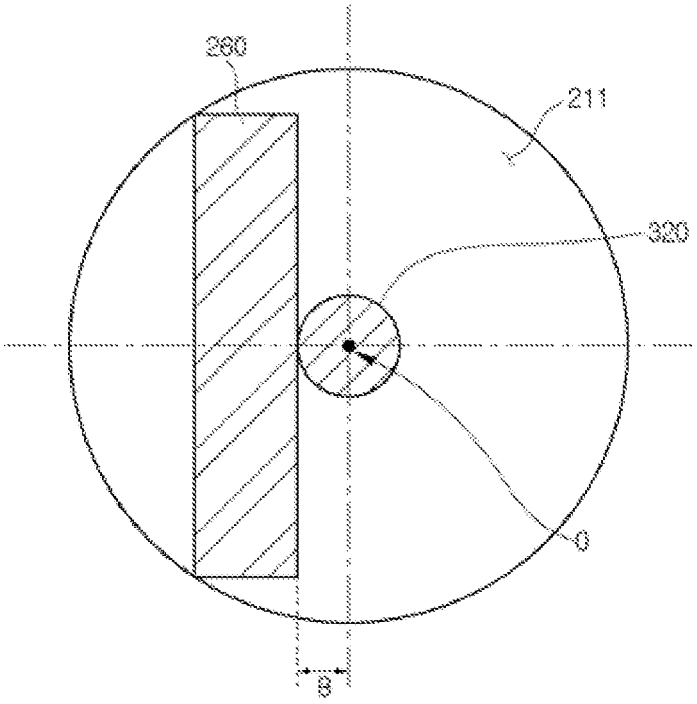
FIG. 9 is a view for explaining positions of an upper end of a communication module and a signal receiving unit in a through hole.

FIG. 7 is a view of a through hole of the lighting device according to an embodiment, and FIG. 8 is a view of a through hole of a lighting device according to another embodiment.

The through hole 211 may vary in position according to the number and arrangement of the LED devices 10 arranged on the LED PCB 210.

Referring to FIG. 7, first LED devices 11 may be disposed in an outer row on the LED PCB 210, and second LED devices 12 may be disposed relatively adjacent to a central portion of the LED PCB 210 when compared to the first LED devices 11.

According to environments where the lighting device is used, the first LED devices 11 may be spaced apart from each other to surround the central portion of the LED PCB 210, but the number of second LED devices 12 may not be sufficient to surround the central portion of the LED PCB 210. For example, the number of LED devices disposed at a left side with respect to the central portion of the LED PCB 210 may be different from that of LED devices disposed at a right side with respect to the central portion of the LED PCB 210.

Here, the through hole 211 may be defined adjacent to an area where the number of the LED devices 10 are relatively low.

In detail, since the signal receiving unit 320 has a shape extending upward from the LED PCB 210, an amount of light in which the light emitted from the LED devices reflects from the signal receiving unit 320 may be considered.

That is, the signal receiving unit 320 may be disposed on an area on which the LED devices are densely provided in consideration of the amount of light generated from the LED device disposed at each position with respect to the signal receiving unit 320. In other words, the LED PCB 210 may be divided into a dense area on which the LED devices are densely arranged and a sparse area on which the number of LED devices is relatively low according to the number of the arranged LED devices. In this case, the through hole 211 may be defined in the area in which the number of the LED devices is relatively low.

In this point of view, when the LED devices are uniformly disposed on the LED PCB 210, the through hole 211 may be defined in the central portion of the LED PCB 210 so that the signal receiving unit 320 may be disposed at the central portion of the LED PCB 210.

That is, as illustrated in FIG. 7, it may be assumed that the first LED devices 11 are disposed on the outer area of the LED PCB, and the second LED devices 12 are disposed relatively adjacent to the central portion of the LED PCB 210 when compared to the first LED devices 11 so that each of the first and second LED devices are disposed to surround the central portion of the LED PCB.

In this case, the through hole 211 and the signal receiving unit 320 may be disposed at the central portion of the LED PCB 210. Since amounts of light generated from all sides of the LED devices with respect to the signal receiving unit 320 are similar to each other, the signal receiving unit 320 may be disposed at the central portion of the LED PCB 210.

The upper end of the communication module 260 passing through the through hole 211 may be fixed to an inner wall of the through hole 211 in a press-fit manner. The position at which the upper end of the communication module 260 is fixed to the inner wall of the through hole 211 may be defined at a position spaced a predetermined distance from a center of the through hole 211. That is, the upper end of the communication module 260 may be fixed to a position B that is eccentrically defined from the center O of the through hole 211.

Since the upper end of the communication module 260 is fixed to the position that is eccentrically defined in the through hole 211 in a press-fit manner, the signal receiving unit 320 connected to the communication module 260 may be disposed in the central portion of the through hole 211. In other words, the upper end of the communication module 260 may be fixed to the eccentric position so that the signal receiving unit 320 is disposed in the central portion of the through hole 211. Thus, distances between the side surfaces of the signal receiving unit 320 and the LED PCB 210 may be the same as each other. Also, the signal interference due to the LED PCB 210 may be minimized.

In the lighting device according to the embodiments, the antenna may reduce the signal interference occurring when the RF signal is transmitted and received, and thus the lighting device may be stably remote-controlled.

Also, since at lease one portion of the communication module passes through the through hole of the LED PCB, the signal receiving unit may be easily coupled to the communication module.

Since the signal receiving unit for radio frequency (RF) communication is disposed a predetermined distance upward from the LED PCB on which the LED devices are disposed, the signal interference occurring when a portion of the signal receiving unit is disposed below the LED PCB may be prevented in advance.

Since a portion of the communication module for processing the signal received by the signal receiving unit, which is connected to the signal receiving unit protrudes a predetermined distance from the LED PCB, the signal may be stably transmitted. That is, since the end of the communication module is coupled to protrude a predetermined height from the top surface of the LED PCB, the signal receiving unit may be easily coupled to the communication module and may stably receive the signal.

Also, in the lighting device, the communication module for remotely controlling the lighting device or communicating with other devices and the converter modules for controlling the LED device may be easily designed.

Since the lighting device has the structure in which the heat emitted from the LED device is released through the housing where the heat dissipation rib is disposed, and the antenna is disposed above the LED device, the performance deterioration of the antenna due to the heat may be prevented in advance.

Figure 10:
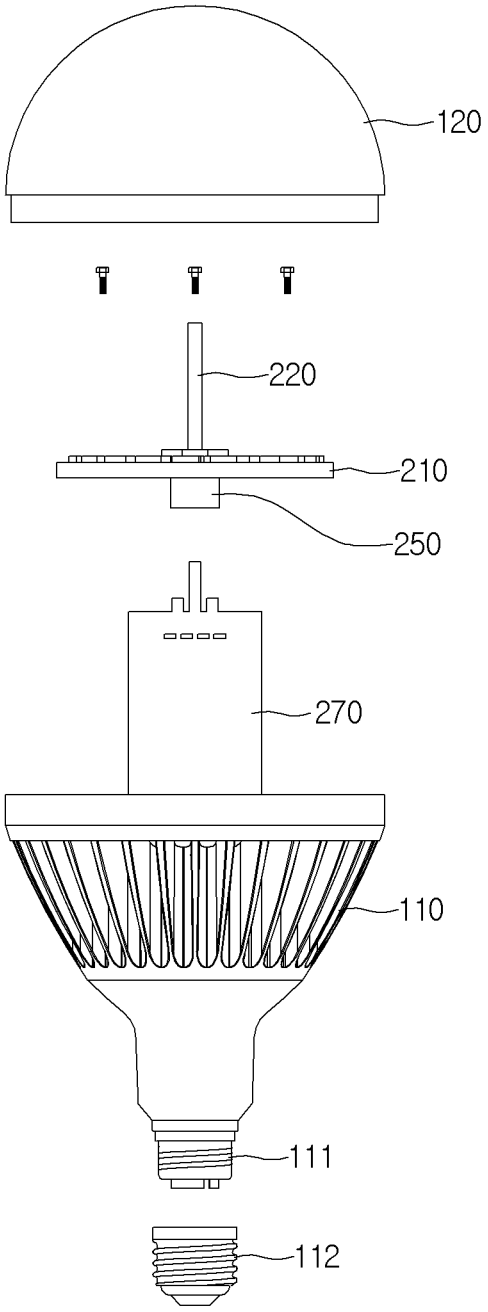
FIG. 10 is an exploded view of a lighting device according to an embodiment as broadly described herein.
Figure 11:
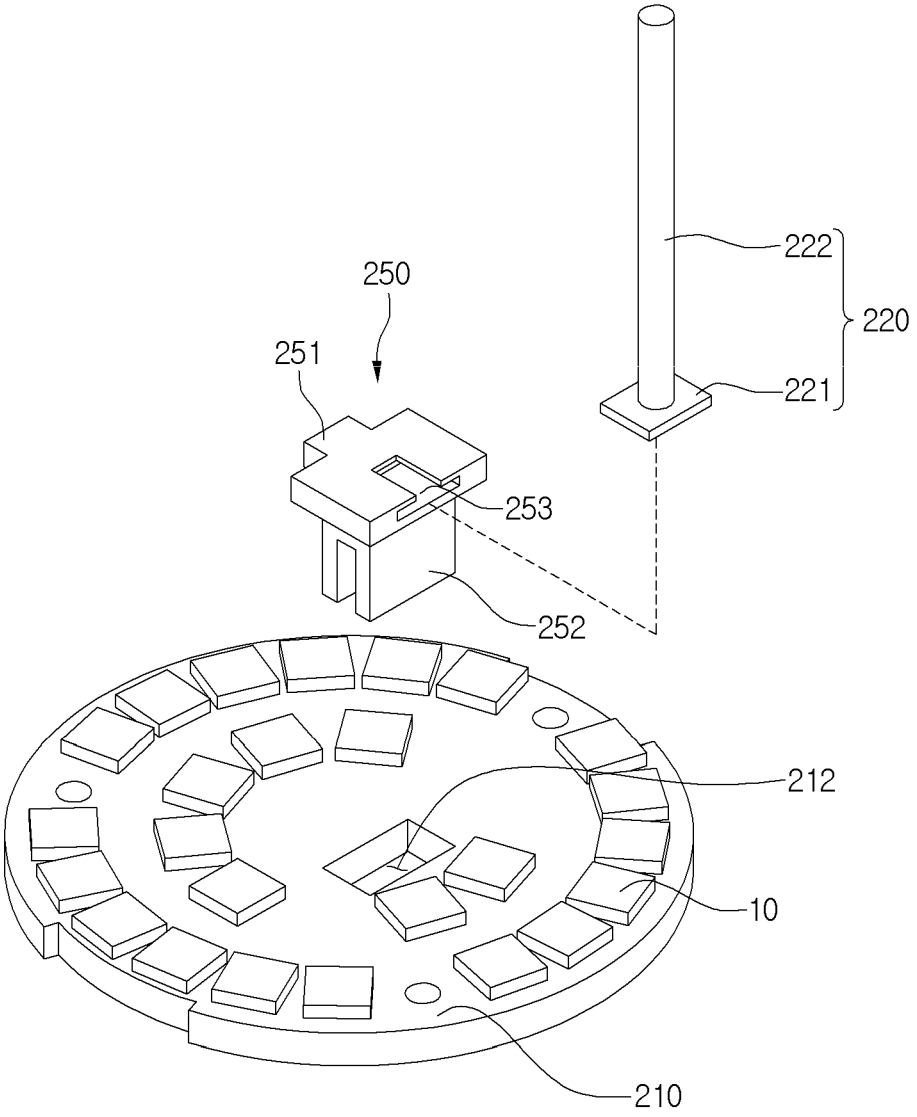
FIG. 11 is a perspective view of an antenna coupling structure of the lighting device shown in FIG. 10.
Figure 12:
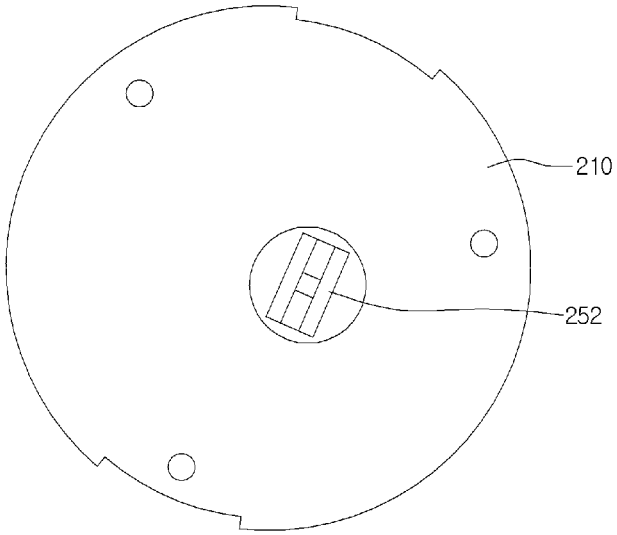
FIG. 12 is a bottom view of an LED printed circuit board (PCB) of the antenna coupling structure shown in FIG. 11.

Referring to FIG. 10, a lighting device, as embodied and broadly described herein, may include a housing 110 defining a lower portion of the lighting device, a converter printed circuit board (PCB) 270 received in the housing 110, a light emitting diode (LED) PCB 210 electrically connected to the converter PCB 270, and a cover 120 surrounding the LED PCB 210.

A power connector 111 may transmit external electric power to the converter PCB 270 and the LED PCB 210 and a socket 112 may surround and protect the power connector 111 and may be connected to an external device. The power connector 111 and the socket 112 may be disposed below the housing 110.

In certain embodiments, the housing 110 may be formed of a material having relatively high conductivity so as to dissipate heat generated by emission of the LED, e.g., a metal. A heat dissipation structure for dissipating heat transmitted to the housing 110 to the outside may be provided on the outer circumferential surface of the housing 110. For example, a plurality of heat dissipation fins may be arranged on the outer circumferential surface of the housing 110. For example, each of the housing 110 and the heat dissipation component of the outer circumferential surface may be formed of aluminum, or other material as appropriate. Moreover, the housing 110 may include a lateral top surface on which the LED PCB 210 may be placed, and hence, increasing a contact area for heat dissipation.

The converter PCB 270, accommodated in the housing 110, may convert common alternating-current (AC) power into direct-current (DC) power to apply DC power to LED devices. A communication module may be mounted on the converter PCB 270, and may be connected to an antenna that is connected to an upper portion of the converter PCB 270.

The converter PCB 270 may be connected to the LED PCB 210 through a positive terminal and negative terminal provided, for example, at upper portion thereof. The LED PCB 210 may control the LED devices using power transmitted from the converter PCB 270.

An antenna connector 250 for connecting a signal receiver 220 may be coupled to the LED PCB 210. It should be appreciated that a signal receiver as disclosed herein is not limited to receiving a signal, but may be used to transmit signals. That is, the signal receiver may function as an antenna and configured to both transmit and receive a radio frequency (RF) signal. The signal receiver 220 may be vertically mounted, extending upright from the LED PCB 210 toward the cover 120. That is, the signal receiver 220 may be mounted on the LED PCB 210 in a direction corresponding to or parallel to a traveling direction (an optical axis direction) of light emitted by the LED device.

Since the signal receiver 220 may be spaced far apart from the converter PCB 270 or the housing 110, noise generated when the AC and DC power are converted and signal interference that may occur while heat is released through the housing 110 may be minimized.

An outer circumferential surface of the signal receiver 220 may be formed of a reflective material so that light emitted by the LED devices advances toward the cover 120 without loss of light. For example, the outer circumferential surface of the signal receiver 220 may be coated with a metal material having relatively high reflectivity. In another embodiment, an outer circumferential surface of an antenna connector 250 may be coated with a material having relatively high reflectivity.

Hereinafter, an antenna coupling structure according to an embodiment will be described in detail.

Referring to FIGS. 2 and 3, a structure in which the signal receiver 220 is coupled to the LED PCB 210 is illustrated, and the plurality of LED devices 10 emitting light are mounted on the LED PCB 210. The LED devices 10 may be, for example, a chip on board (COB) type. The plurality of LED devices 10 may be spaced a predetermined distance from each other.

A connector coupling hole 212 to which the antenna connector 250 is coupled may be defined in the LED PCB 210, and may penetrate the LED PCB 210. For example, the LED devices 10 may be spaced a predetermined distance from each other with respect to the connector coupling hole 212 on the LED PCB 210. Since the signal receiver 220 may extend from the connector coupling hole 221 in a direction in which the light travels, a position of the connector coupling hole 212 may be selected taking into consideration of a path of the light emitted from each of the LED devices 10.

The antenna connector 250 may have a lower portion passing through the connector coupling hole 212 and an upper portion to which the signal receiver 220 is coupled and fixed. In detail, the antenna connector 250 may include a lower connector 252 passing through the connector coupling hole 212 and an upper connector 251 in which an antenna coupler 253 is defined. The antenna coupler 253 may be, for example, a groove having a predetermined depth and defined in the upper connector 251. A size of the groove may be sufficient so that an antenna protrusion 221, or antenna hook 221, of the signal receiver 220 may be inserted and fixed therein.

The signal receiver 220 may also include an antenna body 222 vertically extending from the antenna hook 221. The signal receiver 220 may be a monopole antenna, and may be fixed in position by a hooking structure of the antenna without performing additional soldering or may be fixed by a fixing mechanism such as solder.

The antenna hook 221 may be laterally inserted into the antenna coupler 253. The antenna coupler 253 may be a groove defined in a side surface of the upper connector 251. Also, the upper connector 251 may have a groove having a sufficient size so that the antenna body 222 passes through the groove. The antenna may be coupled to the connector through various methods such as, for example, a press-fit manner.

Hereinafter, with the signal receiver 220 is fixed to the LED PCB 210 by the antenna connector 250, a communication module to be connected to the signal receiver 220 and the converter PCB 270 electrically connected to the LED PCB 210 will be described.

Figure 13:
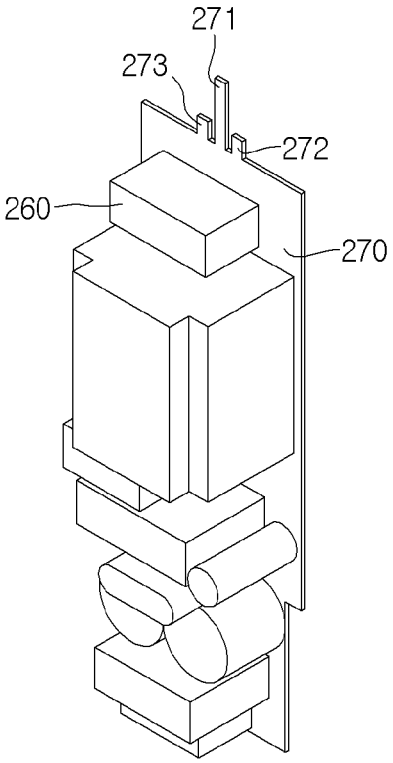
FIGS. 13 and 14 are front and rear perspective views illustrating of a converter PCB of the lighting device shown in FIG. 10.
Figure 14:
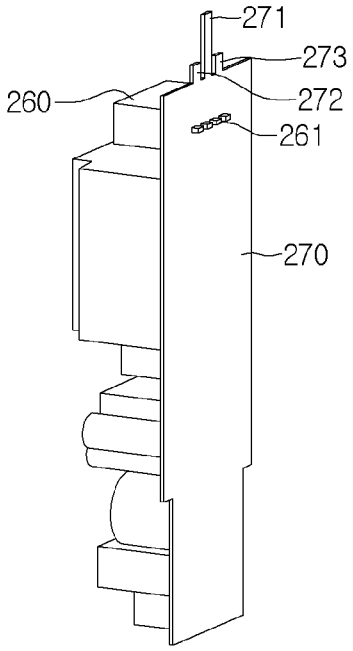
Figure 15:
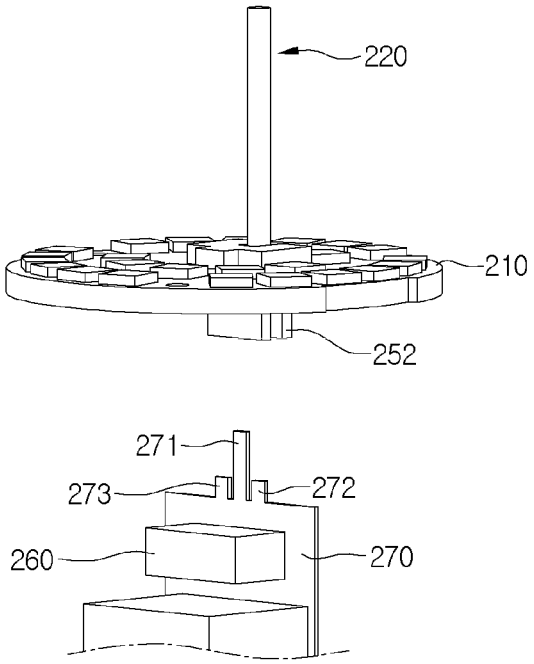
FIG. 15 illustrates a coupling of an antenna, an antenna connector, and the converter PCB of the lighting device shown in FIG. 10.

Referring to FIGS. 13 to 15, the converter PCB 270 may be accommodated in the housing 110 and may convert the externally supplied power into DC power for controlling the LED devices 10. A plurality of electric devices such as a coil, a capacitor, and the like may be disposed on the converter PCB 270.

The converter PCB 270 may include a voltage stabilizer for stabilizing common AC power transmitted from the outside, a rectifier for rectifying and smoothing the stabilized AC power, a smoothing capacitor, and the like. In addition, the converter PCB 270 may include a control integrated circuit (IC) for outputting a control signal to the LED PCB 210 so that turn-on/off of the LED devices 10 may be controlled as well as other appropriate functions of the LED devices such as color, brightness, etc.

The communication module 260 for processing signals transmitted/received through the antenna to remotely control the LED devices 10 may be coupled to the converter PCB 270 in addition to the electric devices.

The communication module 260 may perform RF signal communication. The communication module 260 may process the signals received through the signal receiver 220 to transmit the processed signals to the converter PCB 270. The communication module 260 may process a control signal of the converter PCB 270 or the LED PCB 210 to output the processed control signal through the signal receiver 220.

The communication module 260 may be fixed in position to a main board of the converter PCB 270 by, for example, at least one module contact terminal 261. The communication module 260 may be vertically coupled to the main board of the PCB 270 to improve space utilization.

The converter PCB 270 may include a plurality of protrusions on an upper portion thereof. The protrusions may include an antenna connection protrusion 271 for connecting the antenna connector 250 to the converter PCB 270 and first and second connection terminals 272 and 273 for electrically connecting the converter PCB 270 to the LED PCB 210.

In particular, the antenna connection protrusion 271 may be electrically connected to the lower connector 252, and thus the antenna connection protrusion 271 may be connected to the signal receiver 220 electrically connected to the antenna connector 250. The antenna connection protrusion 271 may extend past an upper surface of the LED PCB 210. The antenna connection protrusion 271 may be connected to the communication module 260 along a communication pattern disposed on the converter PCB 270.

As shown in FIG. 15, the signal receiver 220 coupled to the LED PCB 210 may extend toward the cover 120 disposed thereabove, and may be connected to the converter PCB 270 and the communication module 260 via the antenna connector 250.

When so coupled, the signal receiver 220 may be connected to the antenna connector 250, and then the antenna connector 250 may be coupled to the connector coupling hole 212 of the LED PCB 210. Then, the upper portion of the converter PCB 270 to which the communication module 260 is mounted is connected to the lower connector 252 of the antenna connector 250. The connection terminal for connecting the LED PCB 210 to the converter PCB 270 may be provided on the lower connector 252, at a position that corresponds to the position of each of the first and second connection terminals 272 and 273, so that the converter PCB 270 is electrically connected to the LED PCB 210 by the first and second connection terminals 272 and 273.

Figure 16:
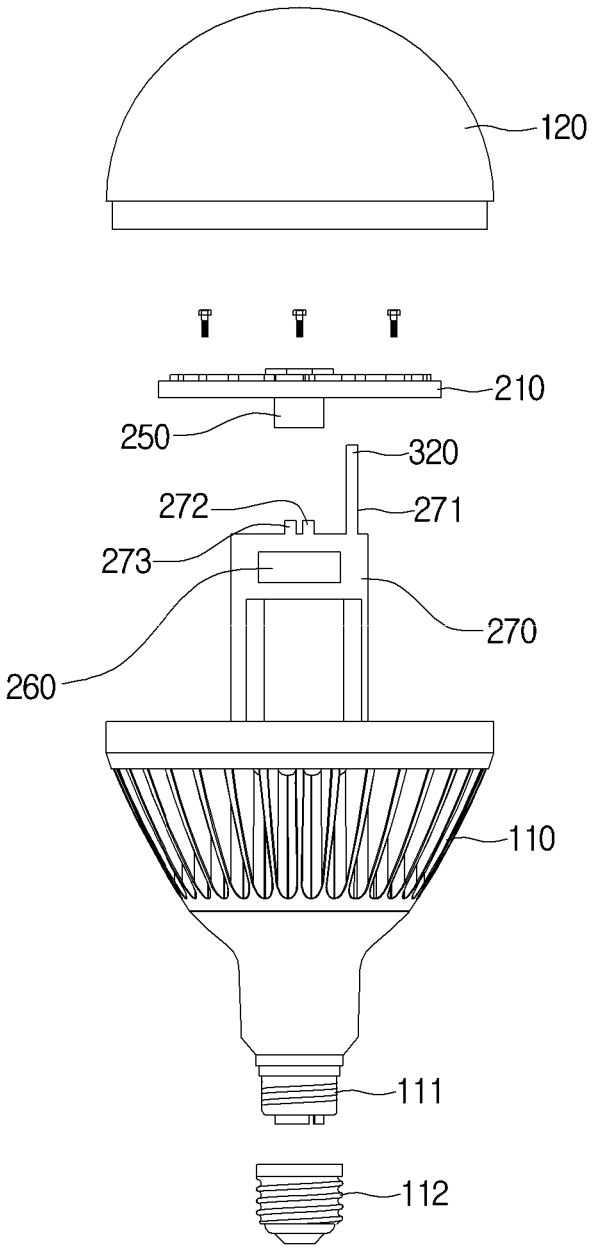
FIGS. 16 and 17 are exploded views of a lighting device according to an embodiment as broadly described herein.
Figure 17:
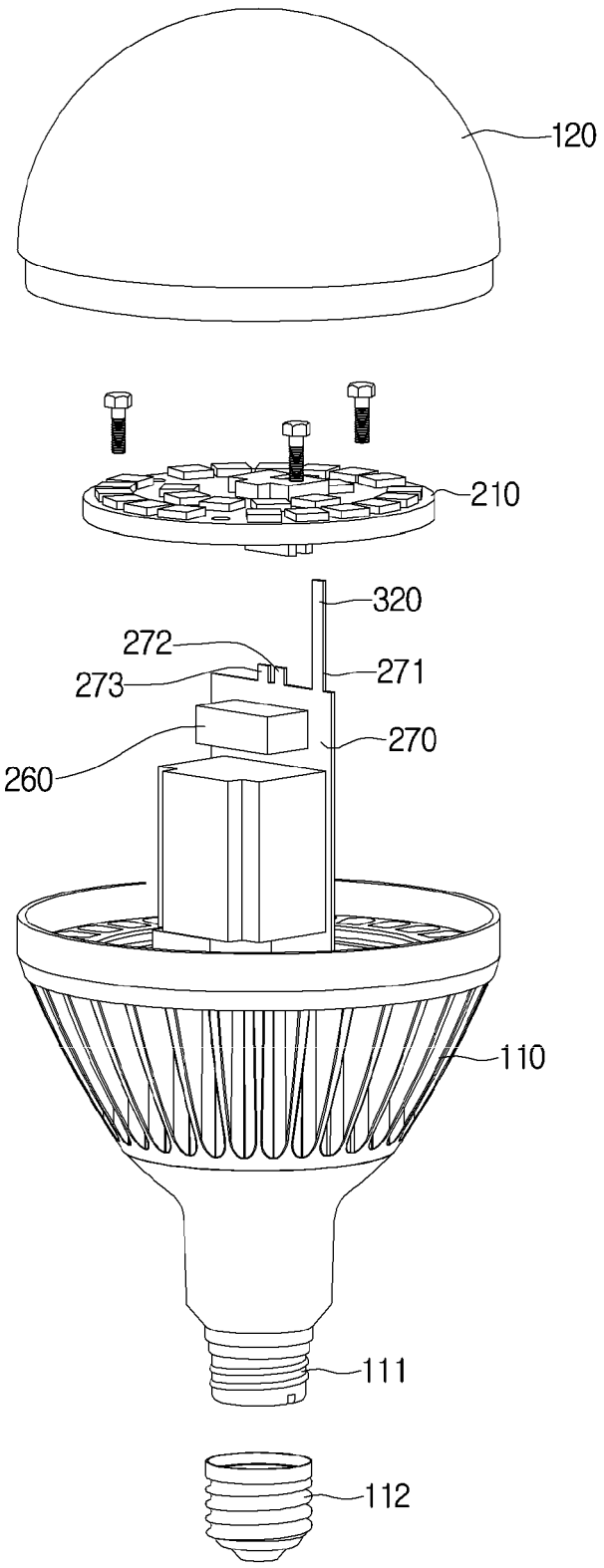
Figure 18:
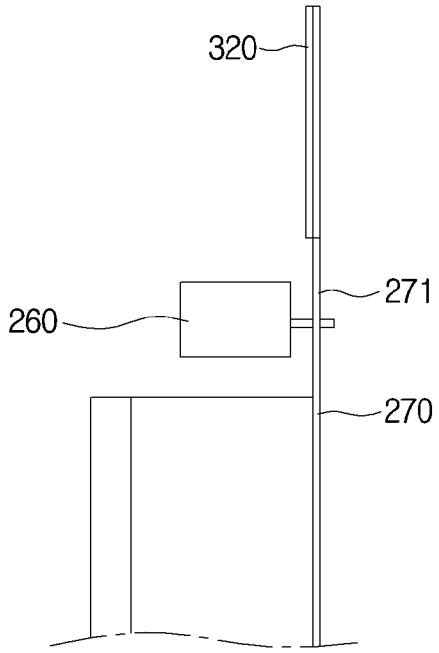
FIGS. 18, 19 and 20 are side, front and rear perspective views, respectively, of a converter PCB of the lighting device shown in FIGS. 16 and 17.
Figure 19:
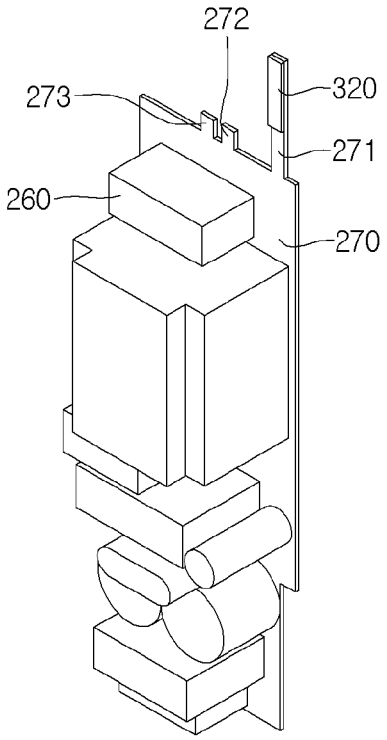
Figure 20:
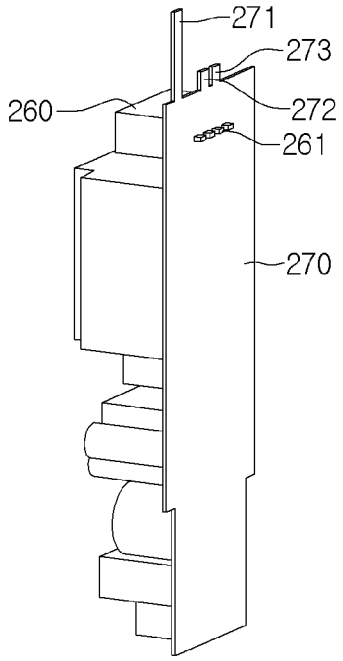
Figure 21:
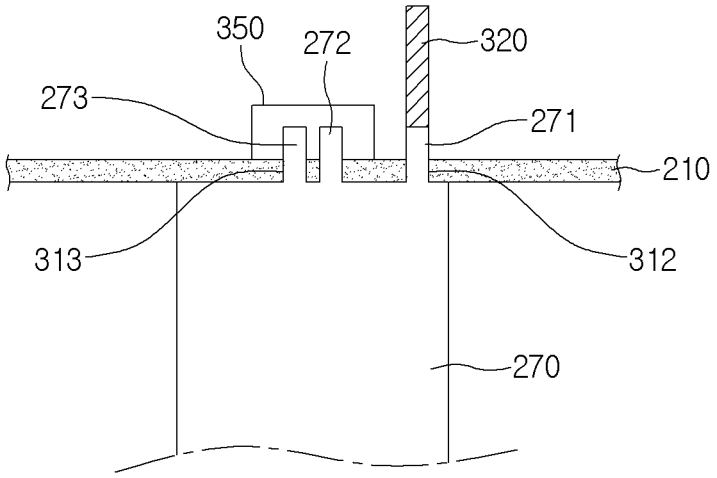
FIG. 21 is a side view of an antenna coupling structure of the lighting device shown in FIGS. 16 and 17.

FIGS. 16 and 17 are exploded views of a lighting device according to an embodiment, FIGS. 18 to 20 are side, front and rear views of a converter PCB of the lighting device shown in FIGS. 16 and 17, and FIG. 21 is a side view of an antenna coupling structure of the lighting device shown in FIGS. 16 and 17.

Referring to FIGS. 16 and 17, a lighting device may include a housing 110 defining a lower portion of the lighting device, a converter PCB 270 accommodated in the housing 110 to output DC power for controlling LED devices provided on an LED PCB 210 that is electrically connected to the converter PCB 270, a cover 120 surrounding the LED PCB 210 to allow light generated by the LED devices to be transmitted therethrough, and a communication module 260 coupled to a main board of the converter PCB 270. The LED PCB 210 may contact an upper surface of the housing 110 to improve dissipation of heat generated by the LED devices 10, and the converter PCB 270 may be placed under the PCB 210 within a cavity formed in the housing 110.

A length of the converter PCB 270 may extend in a vertical direction and be accommodated in the housing 110, and an antenna for transmitting/receiving a radio frequency (RF) signal and at least one connection terminal electrically connected to the LED PCB 210 may be provided on the converter PCB 270. In detail, a signal receiver 320 having a vertically protruding shape, a first connection terminal 272, and a second connection terminal 273 may be provided on the converter PCB 270. The signal receiver 320 and the first and second connection terminals 272 and 273 may be disposed on the converter PCB 270 or may extend from the converter PCB 270.

The signal receiver 320 for transmitting/receiving the RF signal may be connected to an antenna connection protrusion 271 extending from the converter PCB 270 toward the cover 120. For example, the signal receiver 320 may be coupled to an end of the antenna connection protrusion 271, and thus the antenna connection protrusion 271 and the signal receiver 320 may extend toward the cover 120 of the lighting device. The antenna connection protrusion 271 may be integrally formed as a part of the converter PCB 270.

FIG. 18 illustrates a structure in which the signal receiver 320 is disposed on the antenna connection protrusion 271. Also, an end of the signal receiver 320 may be connected to the communication module 260 along an electrical pattern disposed on an outer or inner circumferential surface of the antenna connection protrusion 271.

As shown in FIGS. 19 and 20, the first and second connection terminals 272 and 273 may each protrude from the body of the converter PCB 270 by a predetermined thickness from the converter PCB 270 together with the antenna connection protrusion 271 on which the signal receiver 320 is disposed. As described above, the first and second connection terminals 272 and 273 may be electrically connected to the LED PCB 210.

A structure in which the first and second connection terminals 272 and 273 for electrically connecting the converter PCB 270 to the LED PCB 210 are connected to the LED PCB 210 will be described with reference to FIG. 21.

Referring to FIG. 21, the lighting device may include a plurality of holes defined in the LED PCB 210. In particular, an antenna hole 312 through which the antenna connection protrusion 271 and/or the signal receiver 320 pass, and connection holes 313 sized to accommodate the first and second connection terminals 272 and 273 may be defined in the LED PCB 210. A converter connector 350 connected to the first and second connection terminals 272 and 273 passing through the connection holes 313 may be disposed on a top surface of the LED PCB 210. The converter connector 350 may include grooves for receiving the first and second connection terminals 272 and 273. The converter connector 350 may allow the first and second connection terminals 272 and 273 to be electrically connected to the LED PCB 210.

In the lighting device, since the converter PCB 270 on which the antenna is disposed may be coupled to a lower portion of the LED PCB 210, the signal receiver 320 may be disposed on the LED PCB 210. Thus, since the first and second connection terminals 272 and 273 are coupled to the converter connector 350, the converter PCB 270 is fixed in position.

Figure 22:
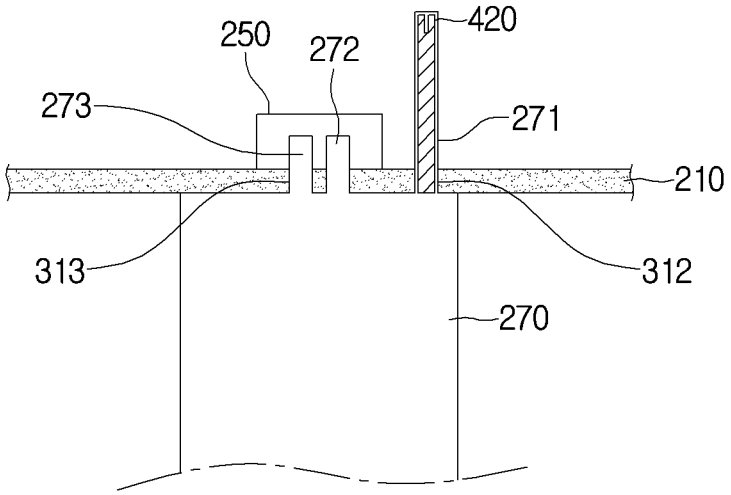
FIG. 22 is a side view of an antenna, according to an embodiment as broadly described herein.

Although the signal receiver 320 is provided as a chip antenna coupled to the antenna connection protrusion 271 in FIG. 21, embodiments are not limited thereto. For example, as illustrated in FIG. 22, the signal receiver 420 may be provided as a pattern antenna disposed on the outer or inner circumferential surfaces of the antenna connection protrusion 271. The signal receiver 320 may be a surface mount type chip antenna as described above, formed integral to the converter PCB 270 using PCB trace, or another appropriate type of antenna structure on the antenna connection protrusion 271.

In detail, FIG. 22 is a view of an antenna according to one embodiment. As shown in FIG. 22, a pattern formed of a metal material may be applied to an inner or outer circumferential surface of an antenna connection protrusion 271 extending from an upper end of a converter PCB 270 toward a cover 120 to form a signal receiver 420. That is, the antenna connection part 271 and the signal receiver 420 may extend from the LED PCB 210 in a light traveling direction.

The signal receiver 420 may be a pattern antenna, with a portion thereof electrically connected to the communication module 260 along the antenna connection protrusion 271.

The lighting device of this embodiment may have the same structure as that as shown in FIG. 7 in that the antenna connection protrusion 271 that extends from an upper end of the converter PCB 270 passes through the LED PCB 210, and the first and second connection terminals 272 and 273 pass through the LED PCB 210 and then are connected to a converter connector 350.

However, in this embodiment, a length of the antenna connection protrusion 271 may be longer than that of the antenna connection protrusion 271 of FIG. 7, and a patterned signal receiver 420 may be applied to or provided in the antenna connection protrusion 271.

Therefore, the antenna for transmitting/receiving an RF signal may experience less distortion or interruption due to a peripheral metal material and may be simply mounted on the lighting device.

Figure 23:
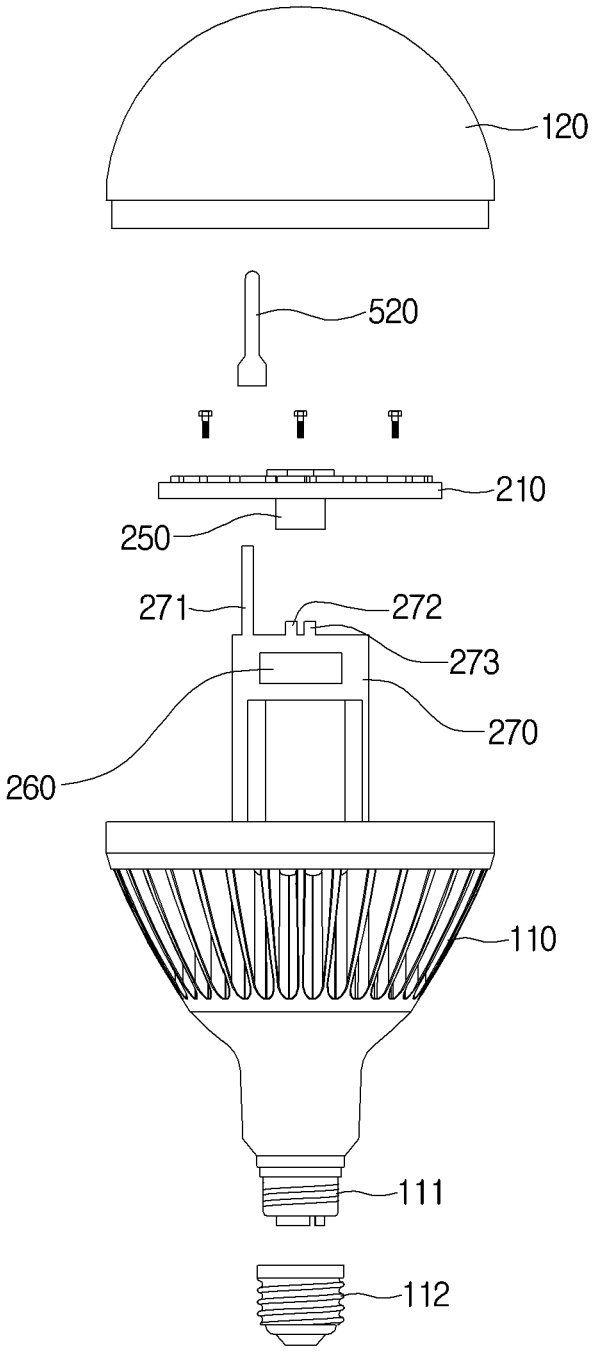
FIGS. 23 and 24 are exploded views of a lighting device according to an embodiment as broadly described herein.
Figure 24:
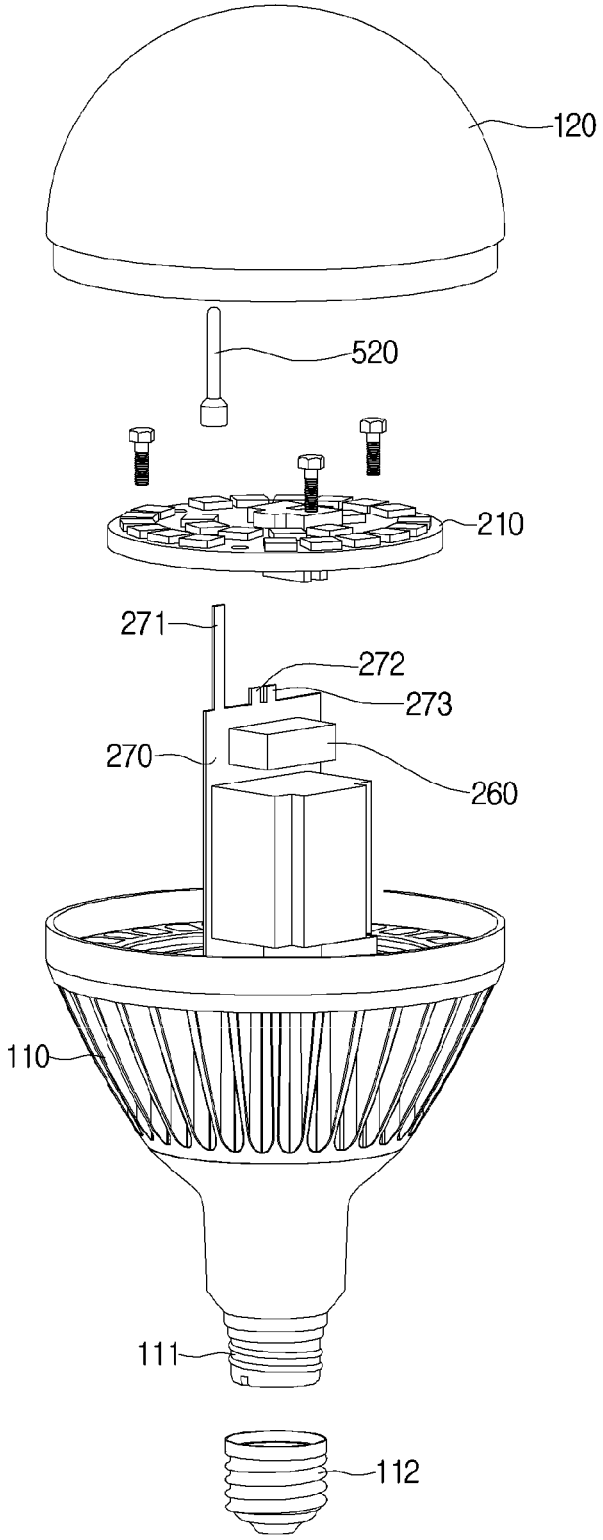
Figure 25:
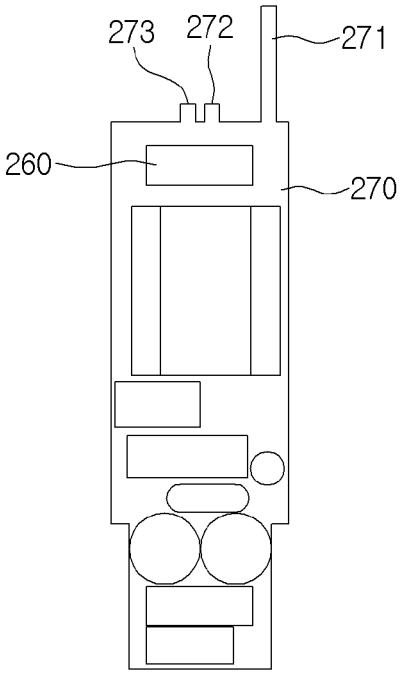
FIGS. 25 and 26 are front and side views, respectively of a converter PCB of a lighting device.
Figure 26:
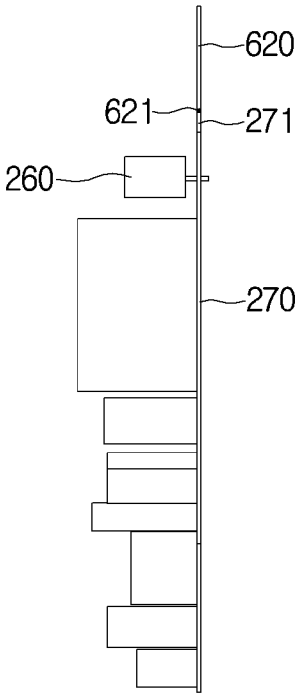
Figure 27:
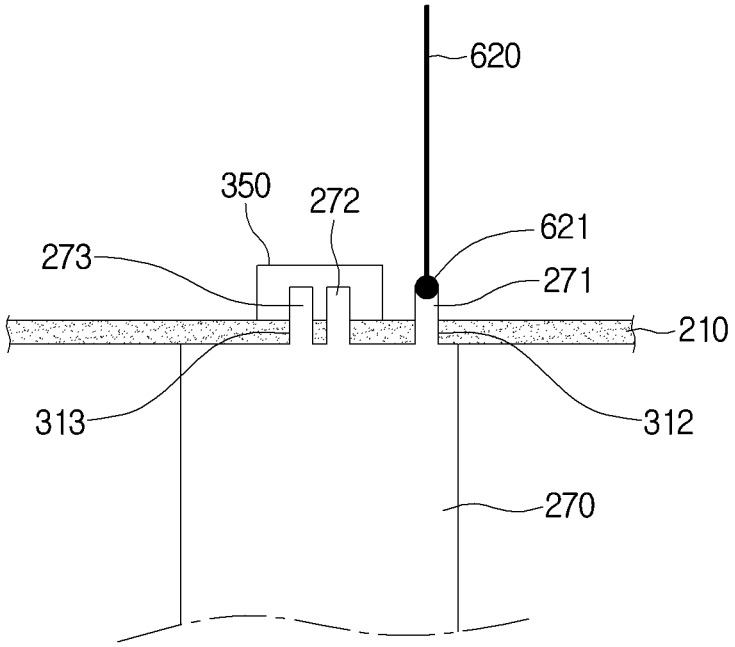
FIG. 27 is a side view of an antenna coupling structure of the lighting device shown in FIG. 26.

FIGS. 23 and 24 are exploded views of a lighting device, FIGS. 25 and 26 are views of a converter PCB of the lighting device, and FIG. 27 is a view of an antenna coupling structure of the lighting device shown in FIG. 26.

Referring to FIGS. 23 and 24, a lighting device may include a housing 110 defining a lower portion of the lighting device, a converter PCB 270 accommodated in the housing 110 to output direct-current (DC) power for controlling LED devices provided on a LED PCB 210 electrically connected to the converter PCB 270, a cover 120 surrounding the LED PCB 210 to allow light generated by the LED devices to be transmitted, and a communication module 260 vertically coupled to a main board of the converter PCB 270.

The converter PCB 270 may extend in a vertical direction while accommodated in the housing 110. An antenna connection protrusion 271 may be coupled to a signal receiver 520 for transmitting/receiving a radio frequency (RF) signal through soldering and at least one connection terminal 272 and/or 273 electrically connected to the LED PCB 210 may be disposed on the converter PCB 270.

In detail, protrusions having a vertically protruding shape may be provided on the converter PCB 270. The protrusions may include the antenna connection protrusion 271 coupled to the signal receiver 520 and the first and second terminals 272 and 273 coupled to the LED PCB 210. The signal receiver 520 may be coupled to the antenna connection protrusion 271 by soldering, friction fitting, or another appropriate method. Moreover, the antenna connection protrusion 271 may extend into a cavity formed in the signal receiver 520 or coupled to a distal end of the antenna connection protrusion 271.

In one embodiment, the signal receiver 520 for transmitting/receiving the RF signal from the communication module 260 may be separately disposed with respect to the converter PCB 270. The signal receiver 520 may be coupled to the antenna connection part 271 of the converter PCB 270 through soldering.

That is, as shown in FIGS. 26 and 27, the signal receiver 620 may be coupled to an end of the antenna connection protrusion 271, with the antenna connection protrusion 271 of the LED PCB 210 passing through an antenna hole 312. The signal receiver 620 may be coupled to the antenna connection protrusion 271 by, for example, solder 621. In addition to the above-described coupling method, various bonding methods may be applied. An outer circumferential surface of the signal receiver 520, 620 as well as the antenna connection protrusion 271 may be coated with a material that may reflect light.

As described above, the first and second connection terminals 272 and 273 formed on an upper end of the converter PCB 270 may be connected into the converter connector 350 mounted on the LED PCB 210. Since the antenna is not disposed in the housing 110 formed of a metal material, but is disposed at a position within the cover 120 at which the RF signal is capable of being easily received, reliability with respect to transmittance/reception of the RF signal may increase.

In a lighting device, as embodied and broadly described herein, the antenna may reduce the signal interference occurring when the RF signal is transmitted/received, and thus the lighting device may be stably remote-controlled.

Since the antenna for the RF communication is disposed on the LED module on which the LED devices are disposed or is disposed in a space between the LED PCB and a bulb, a separate space for installing the antenna is not necessary.

Also, in a lighting device, as embodied and broadly described herein, the communication module for remotely controlling the lighting device or communicating with other devices and the converter modules for controlling the LED device may be easily designed.

Since the lighting device, as embodied and broadly described herein, has a structure in which heat emitted by the LED device is released through the housing where the heat dissipation rib is disposed, and the antenna is disposed above the LED device, performance deterioration of the antenna due to the heat may be prevented.

A lighting device is provided in which an antenna is mounted in the lighting device to remotely control the lighting device, thereby reducing signal interference due to a housing or socket of the lighting device.

In one embodiment, a lighting device as embodied and broadly described herein may include a light emitting diode (LED) printed circuit board (PCB) on which LED devices for emitting light are disposed, the LED PCB controlling an operation of each of the LED devices; a cover disposed above the LED PCB to allow the light to be transmitted; a housing in which the LED PCB is accommodated, the housing having a heat dissipation structure for releasing heat generated from the LED device; a converter PCB providing a direct-current (DC) power to the LED PCB, the converter PCB including at least one protrusion having a sufficient length so that the LED PCB passes; a communication module connected to the converter PCB to communicate with an external device; and a signal receiving unit connected to the communication module, the signal receiving unit extending from the LED PCB toward the cover, wherein the protrusion includes an antenna connection part for connecting the signal receiving unit to the communication module.

In another embodiment, a lighting device may include a LED PCB on which a LED device is disposed, the LED PCB controlling an operation of the LED device; a cover disposed above the LED PCB to allow light of the LED device to be transmitted; a housing in which the LED PCB is accommodated, the housing having a heat dissipation structure for releasing heat generated from the LED device; a converter PCB accommodated in the housing to provide a DC power to the LED PCB; and a communication module connected to the converter PCB to communicate with an external device, wherein a signal receiving unit for receiving a radio signal is disposed on one side of the converter PCB, and an antenna hole having a sufficient size so that the signal receiving unit passes is defined in the LED PCB.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light emitting diode (LED) printed circuit board (PCB) on which LED devices for emitting light are provided, the LED PCB controlling an operation of each of the LED devices;

a converter PCB to supply power into the LED PCB;

a housing having a space in which the LED PCB is accommodated, the housing having a heat dissipation structure to release heat generated from the LED device;

a communication module provided under the LED PCB, the communication module allowing the lighting device to communicate with an external device; and a signal receiver connected to the communication module, the signal receiver being provided on the LED PCB, wherein the LED PCB has a through hole through which an upper end of the communication module passes, wherein the signal receiver is coupled to the upper end of the communication module passing through the through hole, wherein the LED PCB is divided into a first area on which the LED devices are densely provided and a second area on which the LED devices are sparsely provided according to a number of the LED devices, and wherein the through hole is defined in the second area of the LED PCB.

2. The lighting device according to claim 1, wherein a lower end of the signal receiver is coupled to the communication module at a position higher than an upper end of the housing.

3. The lighting device according to claim 2, wherein the upper end of the communication module passes through the through hole and is maintained at a position higher than the upper end of the housing.

4. The lighting device according to claim 1, wherein the upper end of the communication module is provided to be spaced a predetermined distance from a central portion of the through hole, and the signal receiver coupled to the upper end of the communication module is provided in a central portion of the through hole.

5. A lighting device comprising:

a light emitting diode (LED) printed circuit board (PCB) on which LED devices for emitting light are provided, the LED PCB controlling an operation of each of the LED devices;

a converter PCB to supply power into the LED PCB;

a housing having a space in which the LED PCB is accommodated, the housing having a heat dissipation structure to release heat generated from the LED device;

a communication module provided under the LED PCB, the communication module allowing the lighting device to communicate with an external device; and a signal receiver connected to the communication module, the signal receiver being provided on the LED PCB, wherein the LED PCB has a through hole through which an upper end of the communication module passes, wherein the signal receiver is coupled to an upper end of the communication module passing through the through hole, wherein the upper end of the communication module is fixed in position to an inner wall of the through hole in a press-fit manner.

6. The lighting device according to claim 5, wherein a lower end of the signal receiver is coupled to the communication module at a position higher than an upper end of the housing.

7. The lighting device according to claim 6, wherein the upper end of the communication module passes through the through hole and is maintained at a position higher than the upper end of the housing.

8. The lighting device according to claim 5, wherein the upper end of the communication module is provided to be spaced a predetermined distance from a central portion of the through hole, and the signal receiver coupled to the upper end of the communication module is provided in a central portion of the through hole.

9. A lighting device, comprising:

a housing;

a first printed circuit board (PCB) provided in the housing to extend in a first direction and having an opening therein;

an antenna coupled to the first PCB;

a connector fit in the opening of the first PCB, the antenna being coupled to the connector;

a plurality of LED devices provided on the first PCB;

a cover provided over the first PCB to allow light emitted by the plurality of LED devices to be transmitted therethrough;

a second PCB provided in the housing to extend in a second direction different than the first direction and coupled to the first PCB through the connector; and a communication module provided on the second PCB and configured to communicate with an external device, the plurality of LED devices being controlled based on signals received through the communication module, wherein the second PCB is provided to extend through the first PCB through an opening formed in the first PCB, and wherein the communication module is coupled to the antenna provided between the first PCB and the cover, wherein the second PCB includes a plurality of protrusions that extend through the opening of the first PCB, the plurality of protrusions including:

a first protrusion coupled to the antenna through the connector; and first and second connection terminals coupled to the first PCB through the connector.

10. The lighting device of claim 9, wherein the second PCB is perpendicular to the first PCB.

11. The lighting device of claim 9, wherein the antenna has a prescribed shape that covers a portion of the second PCB that extends through the first PCB.

12. The lighting device of claim 9, wherein the antenna and the second PCB extend toward the cover in a direction in which light is emitted by the plurality of LED devices and include a reflective material that reflects the light emitted by the plurality of LED devices.

13. A lighting device comprising:

a housing having a prescribed structure configured to dissipate heat;

a light emitting device (LED) printed circuit board (PCB) including an LED device, the LED PCB being configured to control an operation of the LED device, wherein the LED PCB is coupled to the housing such that heat generated by the LED device is dissipated by the housing;

a cover provided over the LED PCB to allow light emitted by the LED device to be transmitted therethrough;

a converter PCB that provides direct-current (DC) power to the LED PCB; and a communication module coupled to the converter PCB and configured to communicate with an external device, wherein a signal receiver to receive a radio signal is provided on a surface of the converter PCB, and wherein the LED PCB includes an antenna hole having a prescribed size, the converter PCB extending through the antenna hole on the LED PCB such that the signal receiver is positioned in a region between the LED PCB and the cover, wherein the converter PCB includes an antenna connection protrusion that extends from an end of the converter PCB toward the cover, and the signal receiver is provided on the antenna connection protrusion of the converter PCB.

14. The lighting device according to claim 13, wherein the signal receiver is a chip antenna coupled to one surface of the antenna connection protrusion.

15. The lighting device according to claim 13, wherein the signal receiver is an antenna that is patterned on an outer circumferential surface of the antenna connection protrusion or inside of the antenna connection protrusion.

16. The lighting device according to claim 13, wherein a first connection terminal and a second connection terminal are provided on the converter PCB to protrude a predetermined length, and wherein a converter connector is provided on the LED PCB to electrically couple the first and the second terminals to the LED PCB.

17. The lighting device according to claim 13, wherein an outer circumferential surface of the signal receiver or an outer circumferential surface of the antenna connection protrusion is coated with a material configured to reflect light emitted by the LED device.

* * * * *